US009370291B2

(12) United States Patent
Ruiz-Porath et al.

(10) Patent No.: US 9,370,291 B2
(45) Date of Patent: Jun. 21, 2016

(54) SUCTION FOOT FOR A FLOOR CLEANING MACHINE

(71) Applicant: Hako GmbH, Bad Oldesloe (DE)

(72) Inventors: Ricardo Ruiz-Porath, Bad Oldesloe (DE); Heinrich Katenhusen, Bad Oldesloe (DE); Christian Tabeling, Lübeck (DE)

(73) Assignee: Hako GmbH, Bad Oldsloe (DE)

( * ) Notice: Subject to any disclaimer, the term of this patent is extended or adjusted under 35 U.S.C. 154(b) by 0 days.

(21) Appl. No.: 14/721,277

(22) Filed: May 26, 2015

(65) Prior Publication Data

US 2015/0342436 A1 Dec. 3, 2015

(30) Foreign Application Priority Data

May 27, 2014 (DE) ..... 10 2014 107 469

(51) Int. Cl.
*A47L 11/30* (2006.01)
*A47L 11/40* (2006.01)

(52) U.S. Cl.
CPC ..... *A47L 11/4044* (2013.01); *A47L 11/30* (2013.01)

(58) Field of Classification Search
CPC ..... A47L 11/30; A47L 11/4044
USPC ..... 15/401
IPC ..... A47L 11/30
See application file for complete search history.

(56) References Cited

FOREIGN PATENT DOCUMENTS

| | | | |
|---|---|---|---|
| WO | WO-2007/076181 | A2 | 7/2007 |
| WO | WO-2010/073007 | A1 | 7/2010 |
| WO | WO-2011/057228 | A1 | 5/2011 |

*Primary Examiner* — David Redding
(74) *Attorney, Agent, or Firm* — Harness, Dickey & Pierce, P.L.C.

(57) ABSTRACT

A suction foot for a floor cleaning machine having an outer body, which has side pieces having an L-shaped longitudinal cross-section comprising a first horizontal side piece and a second vertical side piece, which extends perpendicular to the first side piece, having an inner body, which is releasably attached to the outer body. The inner body is coupled to the outer body with a sliding movement that is perpendicular to the first horizontal side piece and parallel to the second vertical side piece. A tension band is provided to press a sealing strip against the inner body. The ends of the tension band engage with the ends of the inner body.

8 Claims, 3 Drawing Sheets

SUCTION FOOT FOR A FLOOR CLEANING MACHINE

CROSS-REFERENCE TO RELATED APPLICATIONS

This application claims the benefit and priority of German Patent Application Serial No. 10 2014 107 469.6, filed May 27, 2014. The entire disclosure of the above application is incorporated herein by reference.

FIELD

The present disclosure relates to a suction foot for a floor cleaning machine.

BACKGROUND

This section provides a general summary of the disclosure, and is not a comprehensive disclosure of its full scope or all of its features.

Floor cleaning machines and in particular floor scrubbers operate in such a way that fluid is first applied to the floor that is to be cleaned with the aid of a cleaning head, which is provided with driven brushes, and which is mounted on the machine, wherein the brushes ensure that any dirt that is located on the floor is loosened, and then absorbed by the cleaning fluid. A suction foot, which is also mounted on the floor scrubber, serves to suction up the contaminated fluid.

Suction feet of this kind are known from the prior art and have a slotted strip located in the front as viewed in the direction of travel, which is formed out of rubber, having an edge, which rests on the floor area, and having slots, through which the fluid can pass. A sealing strip, which is likewise made of rubber, is provided on the rear side of the suction foot as viewed in the direction of travel, an edge of which sealing strip rests against the floor area so that a suction area is formed between the slotted strip and the sealing strip. Said suction area is connected to a negative pressure source, which is provided in the floor scrubber, via a suction line. During operation, fluid passes through the slots in the suction area and is then suctioned up through the negative pressure source.

During operation, both the slotted strip and the sealing strip are subjected to a certain amount of wear so that it is necessary to replace both the sealing strip and the slotted strip at regular intervals. In addition, the sealing strip and the slotted strip must be mounted on the suction foot in such a way that the edges thereof that face the floor area rest against the floor area over the entire length of the strip. Furthermore, the slotted strip and the sealing strip must be mounted on the inner body of the suction foot in such a way that the suction area, which is formed between said strips, is well sealed, and that air can only pass through the slots, which are provided in the slotted strip. Finally, the design of the suction foot should be such that a user can change the sealing strip and the slotted strip both quickly and reliably.

It is known from WO 2010/073007 A1 than an inner body can be inserted into a guide groove, which is formed in an outer body of the suction foot, wherein the sealing strip or, respectively, the slotted strip is disposed between the two side pieces of the inner body and the wall of the groove. Such a design is problematic, however, due to manufacturing tolerances both in the outer body and in the sealing strip, the slotted strip and the inner body. On the one hand, this may result in the two strips being inserted in an incorrect orientation, and on the other hand, secondary air may be drawn as a result of leaks.

Furthermore, it is known from WO 2007/076181 A2 that the sealing strip and the slotted strip can be pressed into a groove in an outer body with the aid of a conically shaped inner body. Here however, manufacturing tolerances give rise to the problem that the height of the suction area between the lower surface of the inner body and the sealing and slotted strips varies, so that the suction performance also varies.

Finally, it is known from WO 2011/057228 A1, from which the present disclosure emanates, that a slotted strip is first slid onto domes on a side piece of an outer body, said side piece extending vertically. An inner body is then mounted and finally the sealing strip, wherein the entire assembly, comprising the outer body, the slotted strip, the inner body and the sealing strip, is locked into position with the aid of a tension band, the outer ends of which engage with the free ends of the outer body.

With this arrangement, it may happen that, due to an incorrect attachment to the outer body, and due to the tensioning exerted on the outer body with the aid of a tension band, the inner body is deformed in such a way that the contact surfaces formed on the inner body for the sealing strip and the slotted strip do not extend with the necessary orientation relative to the ground.

SUMMARY

This section provides a general summary of the disclosure, and is not a comprehensive disclosure of its full scope or all of its features.

Based on the above-described problems, one object of the present disclosure is to provide a suction foot, which, on the one hand, can be easily and reliably mounted, and with which an incorrect installation by the operator is excluded.

This object can be achieved by designing the inner body and the outer body in such a way that the inner body is coupled to the outer body with a sliding movement that is perpendicular to the first horizontal side piece and parallel to the second vertical side piece, and that the ends of the tension band engage with the ends of the inner body.

In the case of a design of this kind, the slotted strip is disposed between the vertical side piece of the outer body and the inner body, for example, while the sealing strip, which is located behind said slotted strip as viewed in the direction of travel, is tightened with the aid of the tension band on the inner body. This tightening only occurs when the inner body has already been slid onto the outer body through a sliding movement, which is perpendicular to the first horizontal side piece and parallel to the second vertical side piece, and has been coupled to said outer body. When the inner body is coupled to the outer body and, in particular, rests against the first horizontal side piece, said inner body can no longer be displaced transversely and, in particular, perpendicular to the second vertical side piece.

When tightening, the tension band only engages with the inner body, however, due to the engagement or, respectively, the coupling of the inner body and the outer body, said inner body cannot be deformed relative to the outer body, and during this tightening, there are no forces acting on the outer body, which could deform said outer body.

In a preferred embodiment, additional engagement means are provided in the region of the ends of the inner body and of the first horizontal side piece of the outer body, which engagement means engage with one another when the inner body is slid onto the first horizontal side piece. This makes it possible for no deformation of the inner body to occur after it has been mounted on the first side piece of the outer body, which extends horizontally, even when forces are exerted on the inner body by the tension band.

In a particularly preferred manner, these engagement means are designed in such a way that domes are formed, either on the first horizontal side piece or on the inner body, which domes engage with corresponding recesses either in the first horizontal side piece or in the inner body. Such an embodiment is particularly easy to manufacture.

In addition, it is preferred that the tension band have a first and a second section and that a clamping device be provided, which can assume a released position and a clamping position. In the clamping position, the distance of the free ends of the tension band provided at the ends of the sections, which are located apart from one another, is reduced as compared to the distance in the released position. A clamping device of this kind may be a toggle joint mechanism, for example.

In order to further ensure that the tension band is only tightened when the inner body has already been slid onto the outer body, it is preferred that either the tension band or the outer body, in particular the first horizontal side piece, has a pin, which extends transversely to the second vertical side piece, and the other of the outer body, in particular the first horizontal side piece, and the tension band, has a clip having an elongated hole, which extends in the direction in which the tension band extends. As such, the pin and the clip are disposed in such a way that the pin extends through the elongated hole when the inner body rests against the first side piece and the tension band rests against either the slotted strip or the sealing strip. An assembly of this kind ensures that, in the event that the tension band has already been tightened, when the inner body has not yet been mounted on the outer body and the inner body is then to be slid onto the outer body in this state, the clip first comes into contact with the pin during the sliding movement so that an additional sliding movement that is parallel to the second vertical side piece can no longer occur. This signals to the user that he must first release the tension band, then slide the inner body parallel to the second vertical side piece onto the outer body and then tighten the tension band.

When the tension band is provided with the previously described clamping device, the dimensions of the elongated hole are preferably such that the clamping device can assume both the released and the tightened position when the pin extends through the elongated hole.

The assembly is preferably designed in such a way that the clip is formed on a section of the tension band and the pin is provided on the first horizontal side piece.

Finally, it is preferred that threaded bolts are provided on the inner body, which extend to the first horizontal side piece and which extend through drill holes in the first horizontal side piece. In this way, the movement, along which the inner body is slid onto the outer body prior to tightening, is clearly defined. As such, the inner body can subsequently be locked into place easily with the aid of wing nuts or the like, which are screwed onto the threaded bolts.

DRAWINGS

The present disclosure is explained in greater detail below on the basis of a drawing which merely depicts a preferred exemplary embodiment wherein.

DETAILED DESCRIPTION

Figure 1:
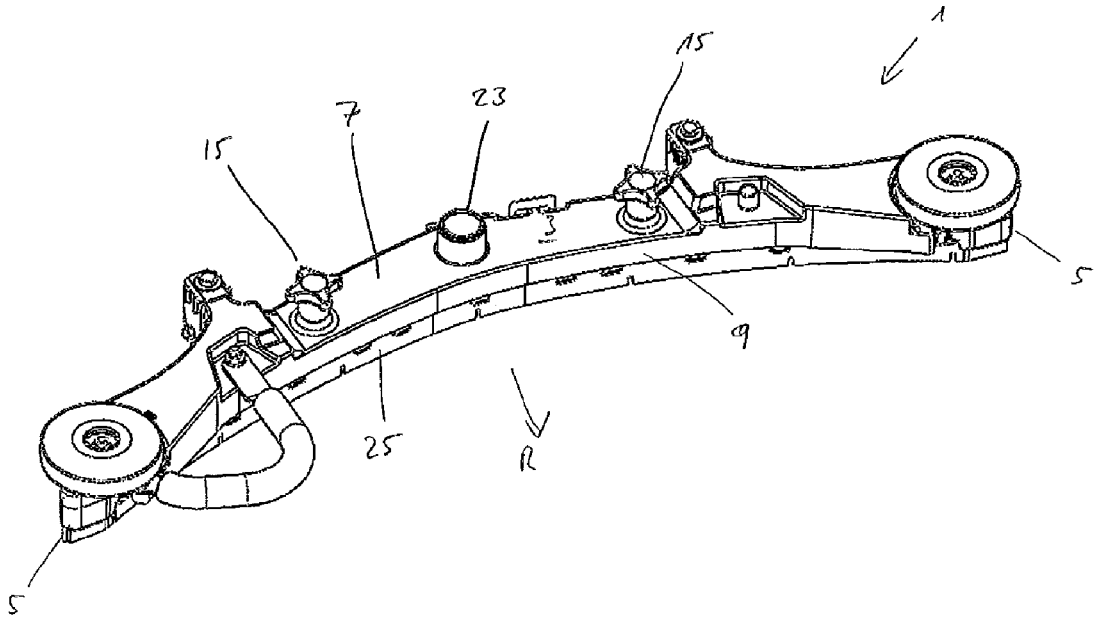
FIG. 1 is a perspective view of the exemplary embodiment from the front.

With reference to FIGS. 1 through 4 of the drawings, an exemplary suction foot 1 constructed in accordance with the teachings of the present disclosure has an outer body 3, which as viewed from above, has a curved course, wherein the free ends 5 of the outer body 3 extend further forward than a middle section as viewed in the direction R, in which direction the suction foot 1 is drawn over the floor area when the floor scrubber, on which said suction foot is mounted, is operated. As is particularly evident from FIGS. 3 and 4, in the cross-section perpendicular to the direction of extension, the outer body 3 has side pieces 7, 9, designed having an L-shape between the free ends 5. As such, a first side piece 7 is provided, which extends horizontal and parallel to the surface that is to be cleaned. A second side piece 9 extends perpendicular thereto in the vertical direction, said second side piece being mounted on the front side of the first side piece 7 as viewed in the direction of travel R. This second side piece 9 is oriented downward from the first side piece 7 to the floor area that is to be cleaned.

Two wheels 11 are provided on the outer body 3, which support the suction foot 1 in a movement over the floor area that is to be cleaned. Finally, a through hole 13 is located in the center of the outer body 3, through which a connecting piece, which will be described in greater detail, is passed, and wing nuts 15 are provided, laterally spaced therefrom, which engage with threaded bolts that will also be described in greater detail.

Figure 2:
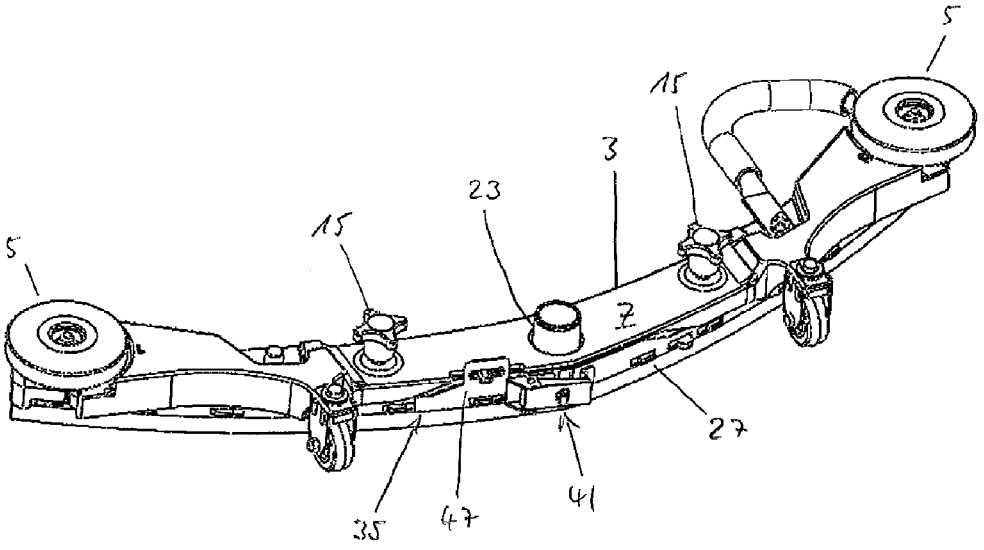
FIG. 2 is a perspective view of the exemplary embodiment also from the rear.
Figure 3:
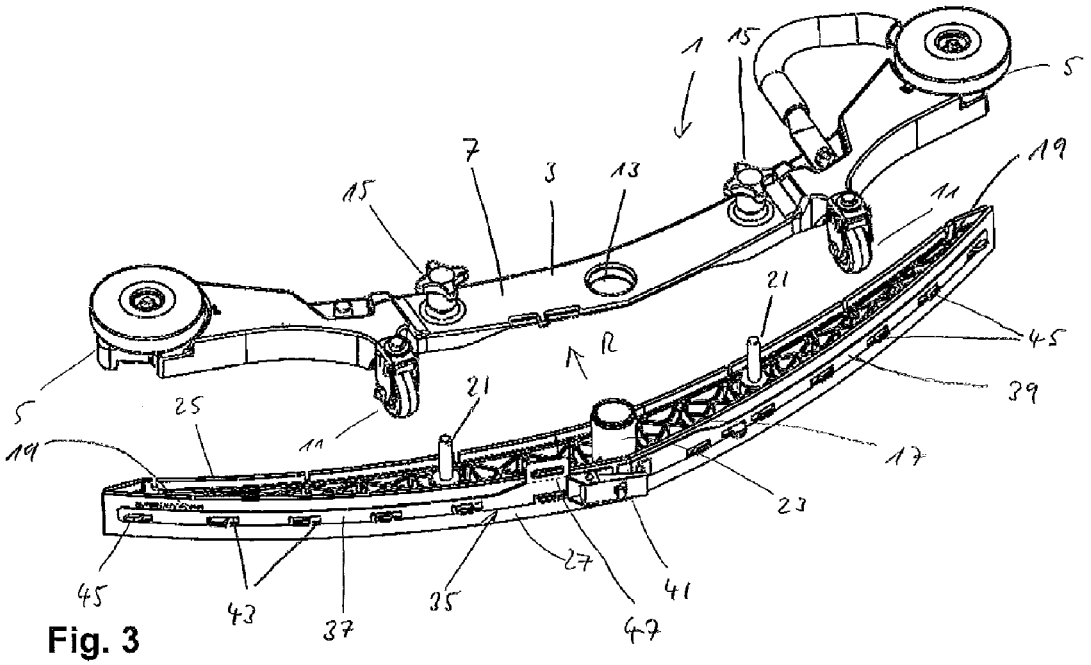
FIG. 3 is a rear view of the exemplary embodiment in a disassembled state.
Figure 4:
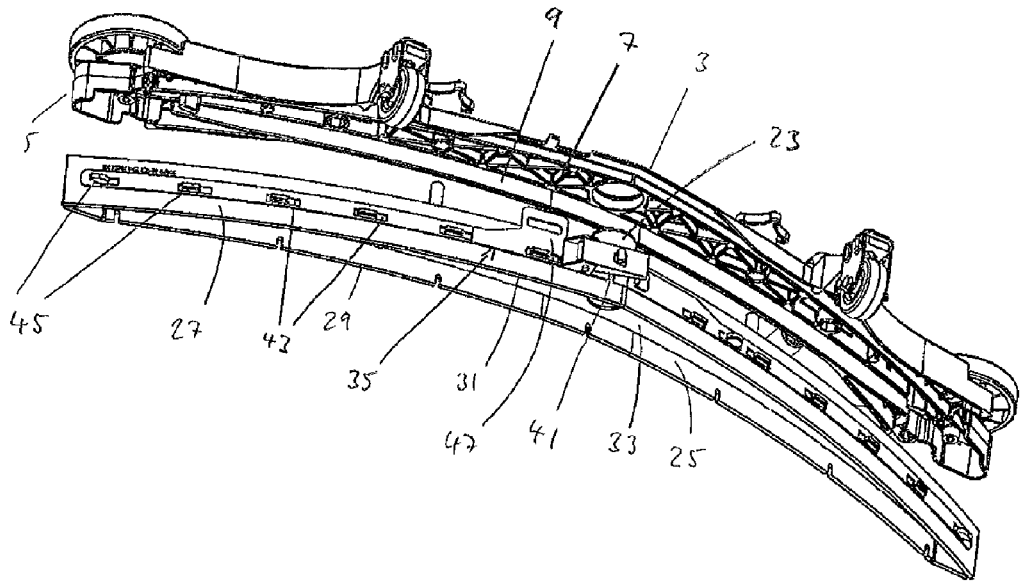
FIG. 4 is a perspective view of the exemplary embodiment in a disassembled state from below.

In addition, the suction foot 1 has an inner body 17, which, like the outer body 3, has a curved course so that the free ends 19 thereof extend further forward than the middle section as viewed in direction of travel R of the suction foot 1, and which inner body has a front and a rear contact surface, which extend perpendicular to the second horizontal side piece 9. Threaded bolts 21, which extend upward, are provided on the inner body 17, which bolts can engage with the wing nuts 15 provided on the outer body 3 so that the inner body 17 can be releasably attached to the outer body 3 with the aid of the threaded bolts 21 and the wing nuts 15, as is shown in FIGS. 1 and 2. As such, the threaded bolts 21 ensure that the inner body 17 is coupled to the outer body 3 with a sliding movement that is perpendicular to the first horizontal side piece 7 and parallel to the second vertical side piece 9. When the inner body 17 is coupled to the outer body 3 and, in particular, rests against the first horizontal side piece 7, said inner body can no longer be displaced transversely and, in particular, perpendicular to the vertical side piece 9.

Furthermore, the inner body 17 has a connecting piece 23, which likewise extends upward with reference to the floor area that is to be cleaned, and which creates a through connection to the lower surface of the inner body 17. In the assembled state, the connecting piece 23 extends through the through hole 13 in the outer body 3 (see FIGS. 1 and 2).

A slotted strip 25 is mounted to the inner body 17 on the front contact surface thereof, on the side that faces frontwards as seen in direction of travel R, and a sealing strip 27 is mounted to the inner body 17 on the rear contact surface thereof, on the side that faces rearwards as seen in direction of travel R, which slotted strip and sealing strip are made of an elastic material, for example such as rubber, which have a lower edge 29, 31, which are brought into contact with the floor area that is to be cleaned, and which extend downward across the lower surface 33 of the inner body 17 so that a suction area is formed below the inner body 17 between the slotted strip 25 and the sealing strip 27, which suction area can be connected to a suction device in the floor scrubber via the connecting piece 23. When in an assembled state, the lower edges 29, 31 of the slotted strip 25 and the sealing strip 27 extend in a common plane, so that the suction area formed is sealed with respect to the floor area that is to be cleaned when the slotted strip 25 and the sealing strip 27 of the suction foot 1 rest against the floor area.

In the assembled state, when the inner body 17 is mounted on the outer body 3, the slotted strip 25, which is mounted on the front side of the inner body 17 on projections, rests against the side of the second vertical side piece 9 that faces rearward, and thus is positioned between the inner body 17 and the outer body 3.

The sealing strip 27 is mounted on the inner body 17 via a tension band 35. The tension band 35 has a first section 37 and a second section 39, which extend outward and away from a clamping device 41, which is designed as a toggle joint mechanism, which is known per se. As such, the sections 37, 39 have openings 43, through which projections 45 provided on the inner body 17 extend. These projections 45 accommodate both the sealing strip 27 and the sections 37, 39 of the tension band 35, in order to hold said band in position on the inner body 17, even when in a released state.

Using the clamping device 41, the tension band 35 can be moved from a released position, in which the sections 37, 39 are spaced further apart from one another, into a clamping position, in which the sections 37, 39 are drawn towards one another.

Figure 6:
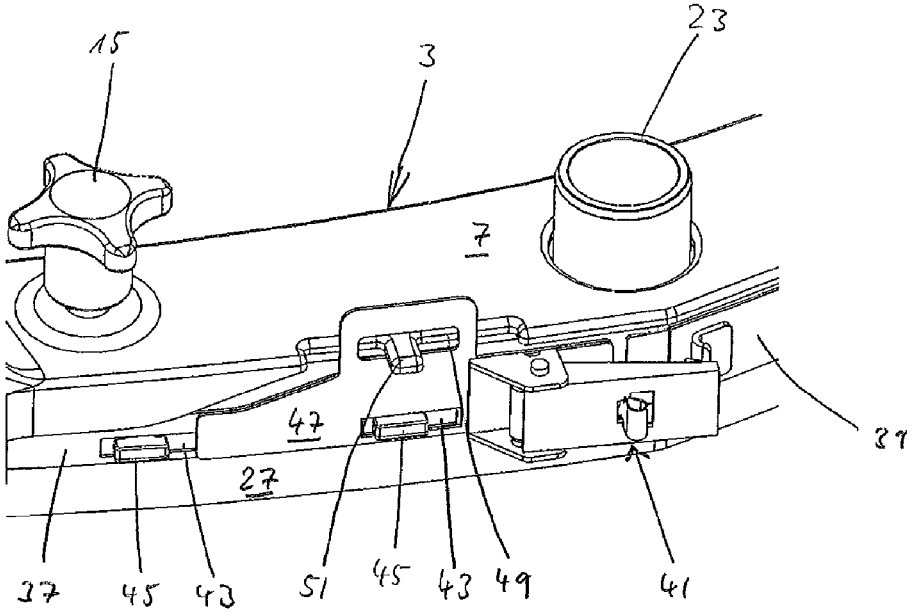
FIG. 6 is a perspective view of a detail in the central region of the suction foot.

A clip 47, which extends upward, is provided on the first section 37 of the tension band 35, said clip being provided with an elongated hole 49 extending parallel to the direction of extension of the first section 37, as shown in FIG. 6. A pin 51 is provided on the first horizontal side piece 7 of the outer body 3 in the region of the clip 47 on the edge that faces rearward, said pin being disposed in such a way that it extends through the elongated hole 29 in the assembled state, in which the inner body 17 is mounted on the outer body 3. Furthermore, the length of the elongated hole 49 is such that, even when the pin 51 extends through the elongated hole 49, said pin does not impede a movement of the first section 37 when the clamping device 41 is tightened, and does not impede the transfer of said clamping device into the clamping position. Thus, when the pin 51 extends into the elongated hole 49, the clamping device 41 can be transferred from the released position into the clamping position.

However, the clip 47 and the pin 51 prevent the inner body 17, having the slotted strip 25 and sealing strip 27 attached thereon, and the tightened tension band 35 from being mounted on the outer body 3 in the vertical direction by sliding the threaded bolts 21 onto the wing nuts 15, since the clip 47 is then brought into contact with the pin 51 and a further movement of the inner body 17 to the outer body 3 is impeded. Thus, the assembly of the clip 47 and pin 51 ensures that the tension band is only attached and tightened after the inner body 17 has been mounted on the outer body 3.

Figure 5:
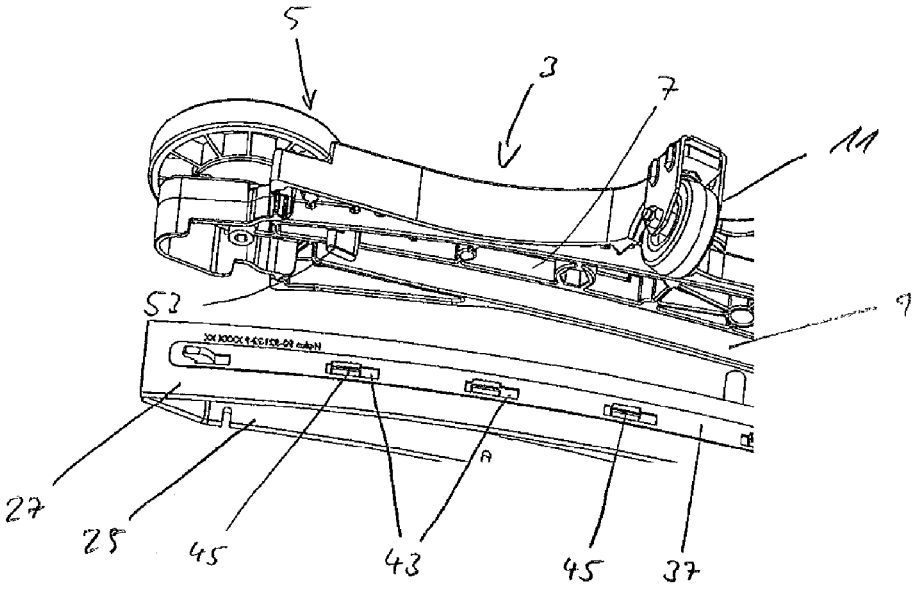
FIG. 5 is a perspective view of a detail at the end of the outer body.

Finally, as is evident from FIG. 5, the side of the first side piece 7 of the outer body 3, which extends horizontally, and which faces downward, has domes 53, which extend downward in the region of the free ends 5, wherein said domes can engage in corresponding recesses in the region of the free ends 19 of the inner body 17. The engagement of the domes 53 further fixes the position of the free ends 19 of the inner body 17 relative to the free ends of the outer body 3.

In the above described embodiment, the slotted strip 25 and the sealing strip 27 are replaced as follows.

First, the suction foot 1 must be detached from the machine, not shown here, by releasing the wing nuts 15. The engagement of the clip 47 and pin 51 prevents the inner body 17 from being released from the outer body 3.

After the clamping device 41 has been released and transferred into the release position, the tension band 35 must subsequently be removed from the inner body 17 in such a way that the sections 37, 39 are removed from the projections 45 when the tension band 35 is in the released position. Because the clip 47 and the pin 51 no longer impede a corresponding movement, after the wing nuts 15 have been released, the inner body 17 can subsequently be removed from the outer body 3. The slotted strip 25 and the sealing strip 27 can then be replaced in that they, in turn, are removed from the corresponding projections 45 and new strips are mounted.

The inner body 17 is subsequently slid back on the outer body 3 through a movement that is perpendicular to the first horizontal side piece 7 and parallel to the second vertical side piece 9, wherein the threaded bolts 21 are screwed onto the wing nuts 15. This can occur only when the tension band 35 has not yet been mounted on the projections 45 on the side of the inner body 17 that faces rearward, since otherwise, the clip 47 would come into contact with the pin 51.

When the threaded bolts 21 of the inner body 17 have been screwed completely onto the wing nuts 15, the tension band 35 can be mounted, wherein the pin 51 then extends through the elongated hole 49 in the clip 47. The clamping device 41 is subsequently transferred into the clamping position, wherein this is not impeded by the dimensions of the elongated hole 49.

This sequence, in which the body 17 is first mounted on the outer body 3 and only then is the tension band 35 tightened, ensures that the inner body 17 is not deformed prior to mounting. When the inner body 17 is mounted on the outer body 3, the threaded bolts 21 as well as the engagement of the domes 53 on the outer body 3 with corresponding recesses on the inner body 17 prevent a deformation of the inner body 17. In turn, it is thereby ensured that the slotted strip 25 and the sealing strip 27 or, respectively, the lower surfaces 29, 31 thereof, actually extend in a common plane, which extends parallel to the floor area that is to be cleaned during use, so that the entire length of the lower surfaces 29, 31 actually rests against the floor area. It is thereby ensured that the suction area formed beneath the inner body 17 is reliably sealed with respect to the floor area and that a negative pressure can be reliably generated therein with the aid of a suction device, not shown here, which is connected to the connecting piece 23. Finally, the suction foot according to the disclosure can be easily assembled.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A suction foot for a floor cleaning machine having an outer body (3), which has side pieces (7, 9) arranged in the longitudinal cross-section in an L-shaped manner comprising a first horizontal side piece (7) and a second vertical side piece (9), which extends perpendicular to the first side piece (7), having an inner body (17), which is releasably attached to the outer body (3), said inner body having a front and a rear contact surface, which extend perpendicular to the first horizontal side piece (7), having an elastic slotted strip (25), which is releasably attached to the inner body (17) on the front contact surface thereof, having an elastic sealing strip (27), which is releasably attached to the inner body (17) on the rear contact surface thereof, and having a tension band (35), which is designed such that said tension band presses the sealing strip (27) against the inner body (17), wherein the slotted strip (25) and the sealing strip (27) extend over the lower surface (33) of the inner body (17), said surface facing downward and away from the first horizontal side piece (7), so that a suction area is formed between the slotted strip (25) and the sealing strip (27), wherein the inner body (17) and the outer body (3) are designed in such a way that the inner body (17) is coupled to the outer body (3) with a sliding movement that is perpendicular to the first horizontal side piece (7) and parallel to the second vertical side piece (9), and wherein the ends of the tension band (35) engage with the ends (19) of the inner body (17).

2. The suction foot according to claim 1, wherein engaging means are provided in the region of the ends (19) of the inner body (17) and of the first horizontal side piece (7), which engaging means engage with one another when the inner body (17) is mounted on the first horizontal side piece (7).

3. The suction foot according to claim 2, wherein the engagement means have domes (53), which are formed on the first horizontal side piece (7), and which extend away from said side piece, and wherein recesses are formed in the inner body (17) in the upper side thereof that faces the first horizontal side piece (7), which recesses are designed to engage with the domes (53).

4. The suction foot according to claim 1, wherein the tension band (35) has a first and a second section (37, 39), wherein a clamping device (41) is provided, which can assume a released position and a clamping position, and wherein, while in the clamping position, the distance of the free ends of the tension band (35) provided at the ends of the sections (37, 39), which are located apart from one another, is reduced as compared to in the released position.

5. The suction foot according to claim 1, wherein either the tension band (35) or the outer body (3) has a pin (51), which extends transversely to the second vertical side piece (9), wherein the other of the first horizontal side piece (7) and the tension band (35) has a clip (47) having an elongated hole (49), which extends in the direction in which the tension band (35) extends, wherein the pin (51) and the clip (47) are disposed in such a way that the pin (51) extends through the elongated hole (49) when the inner body (17) rests against the first side piece (7) and the tension band (35) rests against the sealing strip (27).

6. The suction foot according to claim 5, wherein the dimensions of the elongated hole (49) are such that the clamping device (41) can assume the released position and the clamping position, when the pin (51) extends into the elongated hole (49).

7. The suction foot according to claim 5, wherein the clip (47) is provided on one of the sections (37) of the tension band (35), and the pin (51) is provided on the outer body (3), preferably the first horizontal side piece (7).

8. The suction foot according to claim 1, wherein threaded bolts (21) are provided on the inner body (17), which extend to the first horizontal side piece (7), and which extend through drilled holes in the first horizontal side piece (7).

* * * * *